US008926474B2

(12) United States Patent
Beal

(10) Patent No.: US 8,926,474 B2
(45) Date of Patent: Jan. 6, 2015

(54) ENDLESS BELT ARM EXERCISE DEVICE WITH BRAKING MECHANISM

(76) Inventor: Adam Morris Beal, Colorado Springs, CO (US)

( * ) Notice: Subject to any disclaimer, the term of this patent is extended or adjusted under 35 U.S.C. 154(b) by 30 days.

(21) Appl. No.: 13/354,206

(22) Filed: Jan. 19, 2012

(65) Prior Publication Data

US 2012/0184409 A1 Jul. 19, 2012

Related U.S. Application Data

(60) Provisional application No. 61/434,376, filed on Jan. 19, 2011.

(51) Int. Cl.

| | |
|---|---|
| ***A63B 21/005*** | (2006.01) |
| ***A63B 9/00*** | (2006.01) |
| ***A63B 17/00*** | (2006.01) |
| ***A63B 21/00*** | (2006.01) |
| ***A63B 69/00*** | (2006.01) |
| ***A63B 23/12*** | (2006.01) |
| *A63B 22/02* | (2006.01) |
| *A63B 7/04* | (2006.01) |
| *A63B 21/16* | (2006.01) |

(52) U.S. Cl.

CPC ..... *A63B 21/1488* (2013.01); *A63B 69/0048* (2013.01); *A63B 21/1469* (2013.01); *A63B 23/1209* (2013.01); *A63B 22/02* (2013.01); *A63B 7/045* (2013.01); *A63B 2021/169* (2013.01); *A63B 2220/13* (2013.01); *A63B 2220/805* (2013.01)

USPC ..... 482/5; 482/36; 482/35; 482/37

(58) Field of Classification Search

USPC ..... 482/1, 4–5, 35–39, 49, 52, 62–63, 148, 482/71, 126

See application file for complete search history.

(56) References Cited

U.S. PATENT DOCUMENTS

| | | | | |
|---|---|---|---|---|
| 5,242,341 | A * | 9/1993 | Yeh | 482/52 |
| 5,549,195 | A | 8/1996 | Aulanger et al. | |
| 6,231,482 | B1 * | 5/2001 | Thompson | 482/37 |
| 6,623,409 | B1 * | 9/2003 | Abelbeck | 482/104 |
| 6,860,836 | B1 * | 3/2005 | Wu | 482/37 |
| 7,195,582 | B2 * | 3/2007 | Wu | 482/37 |
| 7,357,757 | B2 | 4/2008 | Brown | |
| 7,387,593 | B2 | 6/2008 | Ryan et al. | |
| 7,572,208 | B2 | 8/2009 | Brewer | |
| 7,686,739 | B2 | 3/2010 | Vanamo | |
| 2008/0119337 | A1 * | 5/2008 | Wilkins et al. | 482/130 |

* cited by examiner

*Primary Examiner* — Loan H Thanh
*Assistant Examiner* — Shila Jalalzadeh Abyane
(74) *Attorney, Agent, or Firm* — MP Patents, LLC

(57) ABSTRACT

An exercise device for exercising a user's arms and upper body includes an endless belt of hingedly connected articulating panels guided in channels of a supporting frame. A pair of hand grip assemblies are slidably attached to the endless belt through a ratcheting mechanism that allows relative movement of the hand grip assemblies in a first direction while preventing said relative movement in a second direction. Movement of the endless belt may be retarded by a tensioning mechanism and completely ceased by a braking mechanism actuated by signals provided from first and second sensors provided on the supporting frame.

1 Claim, 6 Drawing Sheets

ENDLESS BELT ARM EXERCISE DEVICE WITH BRAKING MECHANISM

RELATED APPLICATIONS

This application claims priority to U.S. provisional application Ser. No. 61/434,376 filed Jan. 19, 2011 and entitled Endless Belt Arm Exercise Machine With Braking Mechanism and Tensioning Device.

BACKGROUND OF THE INVENTION

The popularity of peg board climbing has created a market for arm exercise devices. Exercise machines with continuous sliding panels have been recently developed to accommodate users with large gym areas with tall ceilings. These exercise machines provide a continuous arm exercising surface for training and fitness purposes. Some known exercise machines with continuously sliding belts are powered by electric motors. Other exercise machines, such as that described by U.S. Pat. No. 7,572,208 to Brewer (incorporated by reference) harness the user's own weight to power the sliding belts, for users who have limited space to exercise.

A desirable feature of sliding exercise device is a brake mechanism, actuator sensor, and ratcheting hand grips which stop the movement of the exercise device when the exercise device has lowered the user. This mechanism stops the exercise device to accommodate the user when the user needs time to plan a move, to rest, or to terminate the climbing activity. For example, some known exercise device with continuous sliding belts use a cord attached to the user that runs through pulleys to a hydraulic valve or switch that is used to brake the exercise device. Such cords can be effective, but they are inconvenient for the user and can create maintenance issues.

BRIEF SUMMARY OF THE INVENTION

The present invention is an endless belt arm exercise machine that simulates pegboard climbing. Continuous vertical climbing may be provided by the device in an otherwise limited vertical space.

One aspect of the present invention is a braking or arresting means that stops the exercise device after the user terminates the climbing activity. Various means are possible to provide this braking or arresting action of the exercise device. There are several mechanisms for electrical-mechanically braking the exercise device. These mechanisms all involve means to sense when the user is at the appropriate height or a predetermined position.

The exercise device braking actuator mechanism of the present invention uses sensors to indicate when the user's hands are near the top level. The sensors generate an electrical signal that when applied to the braking actuator mechanism instructs the braking actuator mechanism to engage thereby preventing the exercise device from sliding.

Another aspect of the device is a tensioning device provided to prevent any sudden acceleration of a user exercising on the device. The tensioning device applies a retarding force to a shaft of the exercise device to balance user weight applied to the device and slow movement of an endless belt so that the endless belt may be easily climbed by the user.

A third aspect of the device is handle grip assemblies for grasping by the user. These assemblies mimic the pegs provided in pegboard climbing and are provided with ratcheting mechanisms for replacement of the holes normally found in a pegboard.

DETAILED DESCRIPTION OF THE INVENTION

It should be understood that steps of any disclosed methods of the present invention may be performed in any order and/or simultaneously as long as the invention remains operable. Furthermore, it should be understood that the apparatus and methods of the present invention can include any number or all of the described embodiments as long as the invention remains operable.

The present teachings will now be described in more detail with reference to exemplary embodiments thereof as shown in the accompanying drawings. While the present teachings are described in conjunction with various embodiments and examples, it is not intended that the present teachings be limited to such embodiments. On the contrary, the present teachings encompass various alternatives, modifications and equivalents, as will be appreciated by those of skill in the art. Those of ordinary skill in the art having access to the teachings herein will recognize additional implementations, modifications, and embodiments, as well as other fields of use, which are within the scope of the present disclosure as described herein.

Figure 1:
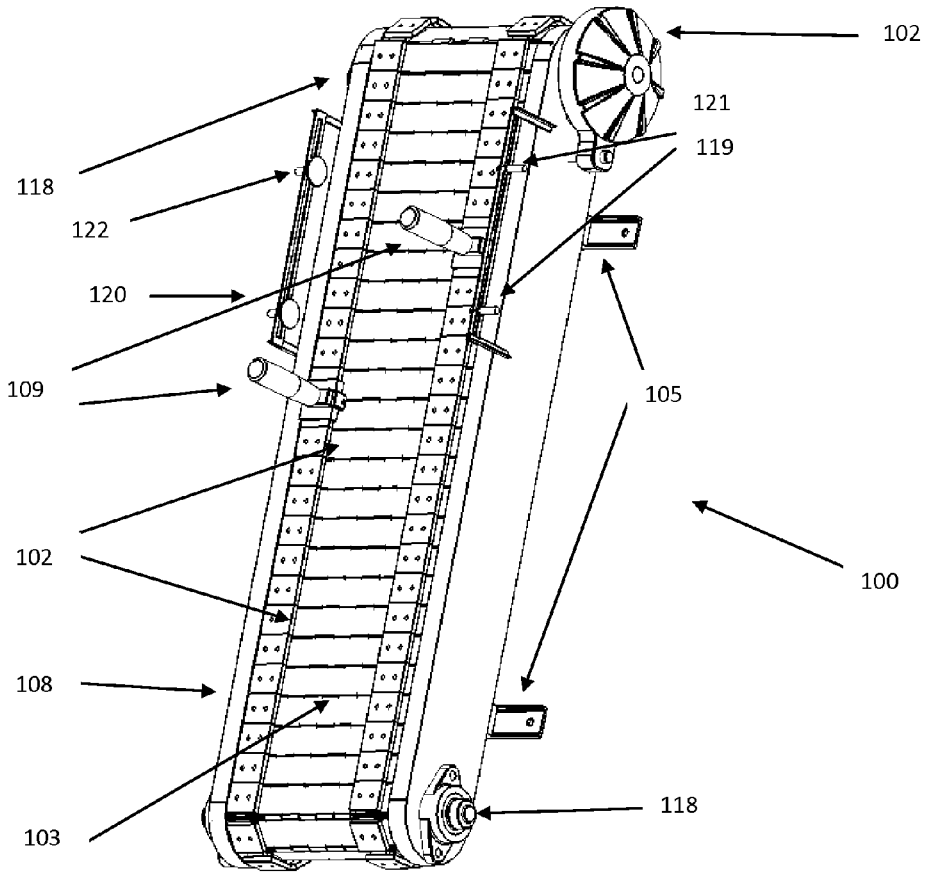
FIG. 1 illustrates an upper body exercise device in accordance with the present invention.
Figure 2:
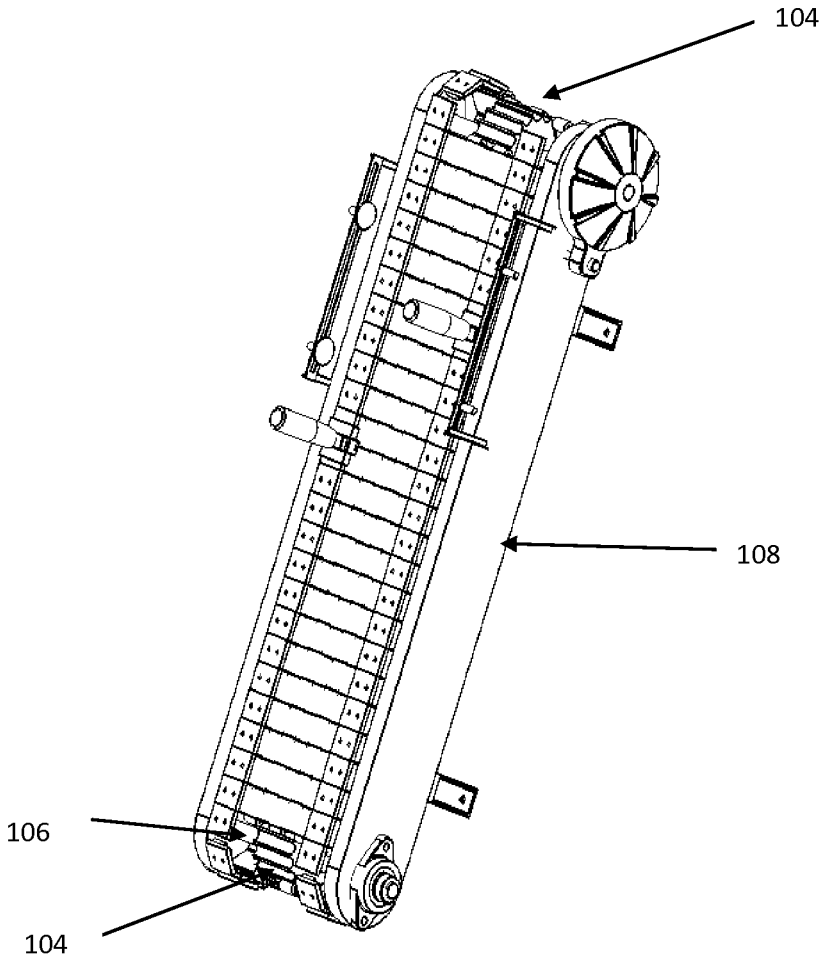
FIG. 2 illustrates the upper body exercise device with select articulating panels removed to reveal shafts and sprockets.

As depicted generally in FIGS. 1 and 2, the upper body exercise device 100 includes a plurality of articulating panels 102 hinged together at hinge elements **102*h* to form an endless loop 103 driven by sprockets 104. While the dimensions of the articulating panels 102 are preferably approximately 2' wide, about 1½" in high and about ¾" thick, other dimensions may be desirable. The panels 102 are preferably formed of a substantially rigid, lightweight, smooth and durable material such as acetyl. The exercise device 100 is intended to be mounted to a vertical surface such as a wall by feet 105 to provide a continuous climbing experience to a user without the limitation of wall or ceiling height. Sprockets 104 at either end of the device are fixedly engaged to shafts 106 which are rotatably supported by through-holes 107 in the frame 108 at opposite ends. Motion of articulating panels 102 in a vertical direction causes a rotation of sprockets 104 and thereby a rotation of shafts 106 within the frame 108**.

Ratcheting hand grip assemblies 109 are attached to the plurality of articulating panels 102 through two plates fastened to opposite ends of individual articulating panels 102. A lock plate 110, which attaches directly to the outer surface of a articulating panel 102, is shaped in the general form of a rectangle having at least one angular ratchet tooth 111 projecting towards the center of the articulating panel 102. A retaining plate 112 is mounted to a face of the lock plate 110 remote from the articulating panel 102. The width of the retaining plate 112 is greater than that of the lock plate 110 such that a space the same thickness of the lock plate 110 exists between the retaining plate 112 and the articulating panel 102.

This space allows for the side edges of the retaining plate 112 to function as rails to guide troughs 113 extending from the handle grip assembly 109 on either side. In this way, the handle grip assembly 109 is permitted to slide along the surfaces of a plurality of retaining plates 112 while being constrained by the rails and troughs 113. The handle grip assemblies 109 are further provided with a pivoting lever 114 to engage the ratchet tooth 111 of the lock plate 110 thereby permitting unrestricted motion of the handle grip assembly 109 in a first direction relative to the lock 110 and retaining plates 112 and articulating panels 102 while completely preventing relative motion in a second, opposite direction. When assembled to a wall-mounted exercise device 100, handle grip assemblies 109 are permitted to move in a vertically upward direction along a series of interconnected articulating panels 102 but prevented from moving vertically downward relative to said articulating panels.

Figure 3:
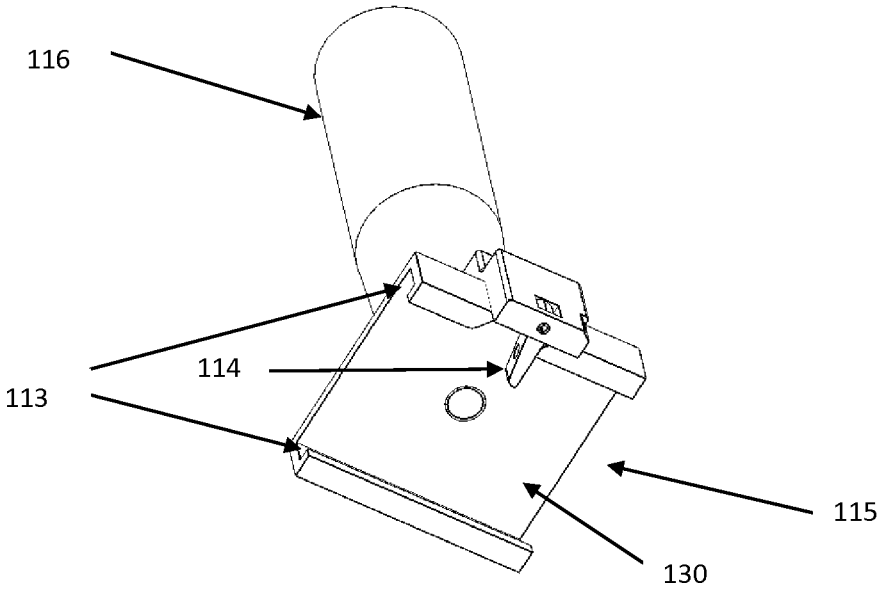
FIG. 3 illustrates a handle grip assembly
Figure 4:
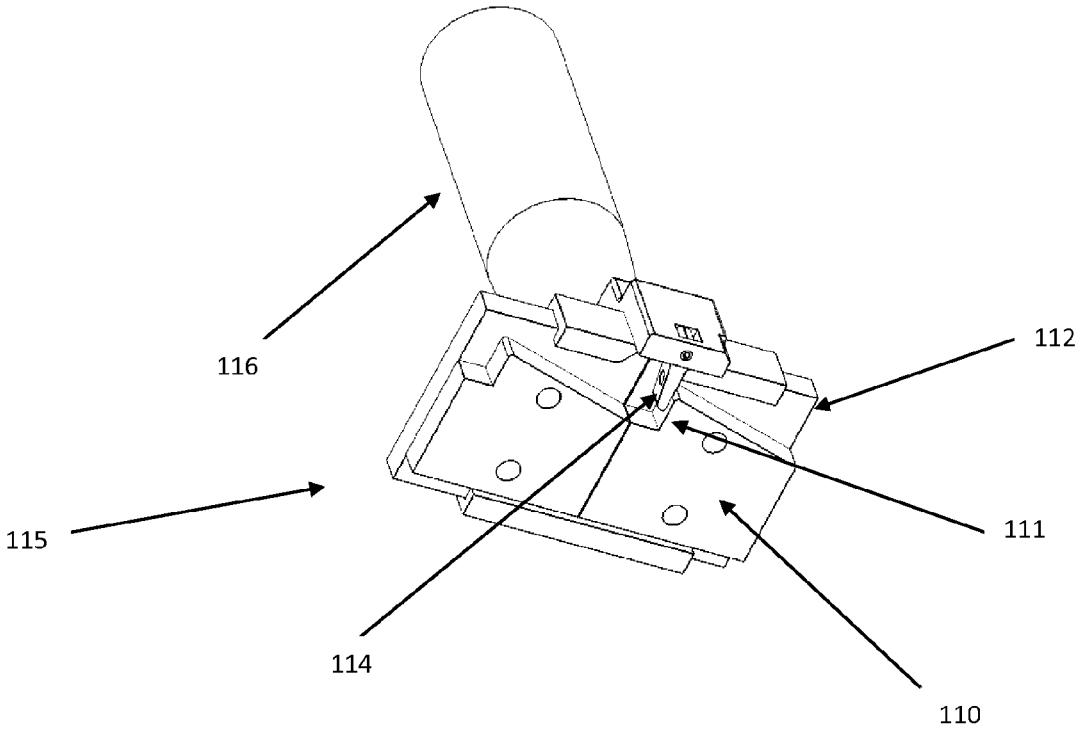
FIG. 4 illustrates a handle grip assembly engaged with lock and retaining plates.
Figure 5:
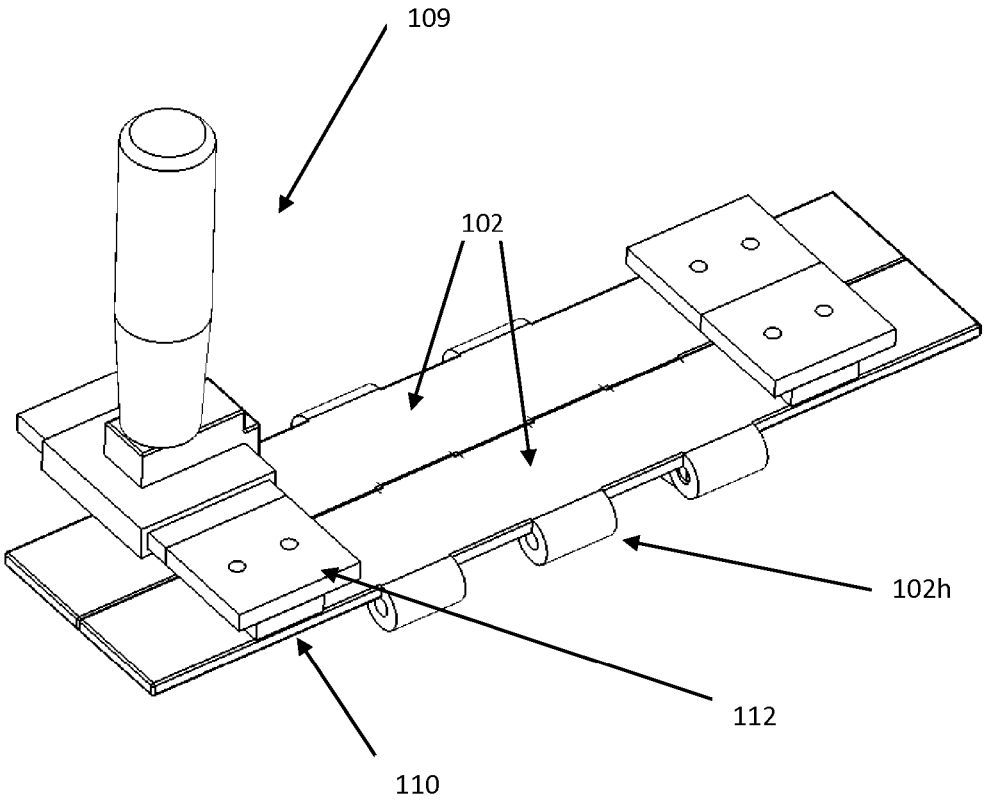
FIG. 5 illustrates a handle grip assembly engaged with articulating panels through the lock and retaining plates.
Figure 6:
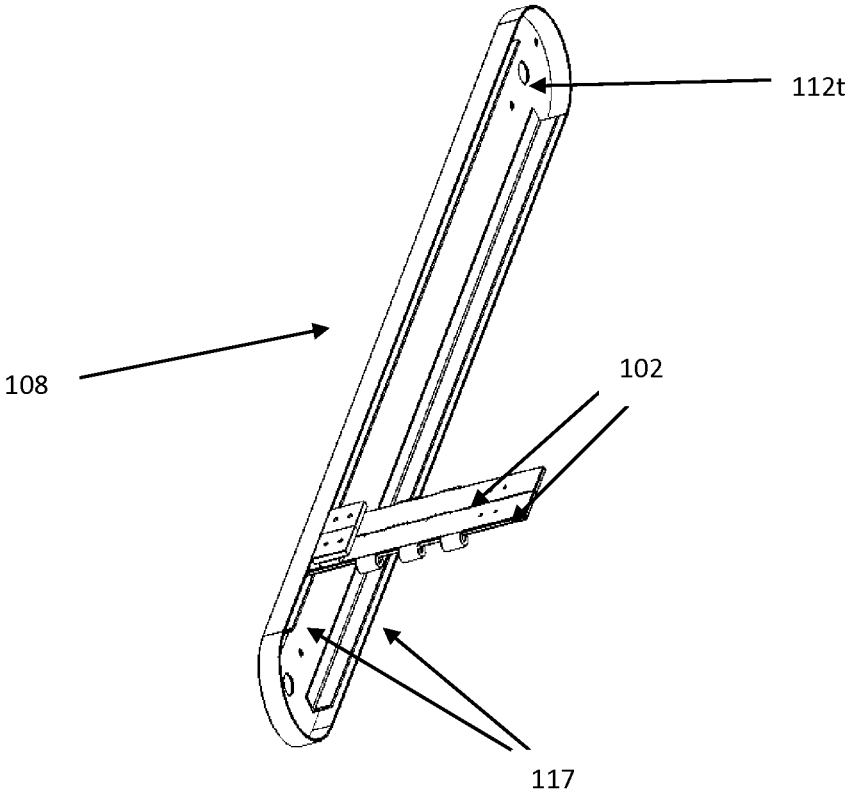
FIG. 6 illustrates guide rails of the exercise device frame.

As seen FIG. 3, the hand grip assembly 109 is comprised of lower rectangular 115 and upper handle 116 portions. The lower rectangular portion 115 defines a bottom surface 130 slidably mated to the outward surface of the retaining plate 112 and troughs 113 slidably engagable with the vertical side edges of the retaining plate 112. In the embodiment depicted in FIG. 3 upper handle portion 116 is in the form of a circular cylinder fixedly attached to and extending away from lower rectangular portion 115. The outer surface of the cylindrical upper grip portion 112 is provided to be engaged by the grasping fingers and hands of the user. The upper handle portions 116 could be formed normal to the climbing surface, as shown, or parallel thereto.

Because in use a torque will be applied to the articulating panels 102 by the user through upper handle portions 116 of handle grip assemblies 109, they will experience a rotation about their longitudinal axis. To restrict this rotation, a frame 108 is provided which forms a guiding channel 117 at each side of the exercise device 100 extending in the direction of the series of articulating panels 102. Each guiding channel 117 slidably receives one end of each of the articulating panels 102 of chain 103. Because the width of the guiding channel 117 is not significantly greater than the thickness of the articulating panels 102, diagonal corners of the articulating panels 102 engage with surfaces of the guiding channels 117 when rotated by the applied torque and further rotation is prohibited. When a articulating panel 102 is un-weighted by a user, it will be permitted to slide down the guiding channels 117 with very little twisting moment and, therefore, very little frictional force is transmitted to the guiding channels 117.

In one embodiment the guiding channels 117 comprise a liner that is designed to reduce friction between articulating panels 102 and guiding channels 117. Using a liner with metal material will reduce friction when engaged with the articulating panels 102 and will also reduce noise generated when the plurality of articulating panels 102 slide in the guiding channels 117.

Because the weight of a user applied through handle grip assemblies 109 to an articulating panel 102 would otherwise tend to cause rapid downward motion of the panel 102 and any user supported by the panel 102, a tensioning mechanism 118 is provided on the frame 108 of the exercise device 100 to retard the rotation of shafts 106 and attached sprockets 104. Retarding the rotation of sprockets 104 slows articulation of the endless loop 103 of hingedly connected articulating panels 102 to prevent rapid falling of the user engaged articulating panel 102. The tensioning mechanism 118 is adjustable to provide various user-set degrees of retardation to appropriately balance against the weight of the user and avoid downward acceleration of said user.

In use, a user grasps first and second upper handle portions 116 of the handle grip assemblies 109, with first and second hands, and pushes the first upper handle portion 116 in an upward vertical direction causing motion of the grip assembly 109 relative to lock 110 and retaining plates 112 and articulating panels 102. When the user has extended his first hand upwards as far as possible according to the length of his first arm, the grip assembly 109 may descend slightly such that the pivoting lever 114 engages the upper surface of the ratchet tooth 111 of the lock plate 110 to prevent any further downward motion of the grip assembly 109 relative to the articulating panel 102. By the first upper handle portion 116, the user may support his weight to allow pushing of the second upper handle portion 116 upwards until it's pivoting lever 114 engages the upper surface of the ratchet tooth 111 of the respective lock 110 plate.

If the user did not begin completely supported by the handles (i.e. user started with feet on the ground) the user will eventually find themselves in this completely supported position as they continue alternating advance the upper handle portions 116 and handle grip assemblies 109 upwards.

To allow the user to climb in a position near the upper end of the exercise device, a braking mechanism 102 is used to completely prevent rotation of upper shaft 106, sprocket 104 and thus downward articulation of the endless belt 108.

When the device is on and the user is climbing below the region defined by sensors 119 and 121 and reflectors 120 and 122, the braking mechanism 102 prevents downward articulation of the endless belt 108 of articulating panels 102. Sensors 119 and 121 emit a focused beam towards reflectors 120 and 122. When nothing obstructs a beam from one of the sensors 119 and 121, emitted beams are reflected back to and received by sensors 119 and 121.

In this way, once the user begins climbing at the elevation of the first sensor 119, the beam emitted from the first sensor 119 is broken. As the user continues to climb and the elevation of the second sensor 121 is reached, the beam emitted from the second sensor 121 is broken. Break mechanism 102 is disengaged allowing articulating panels 102 and the user-facing portion of endless belt 108 to move downward only when both emitted beams of sensors 119 and 121 are broken. Otherwise, both sensors 119 and 121 continuously emit beams which are reflected by reflectors 120 and 122 and received back at sensors 119 and 121. In this state, signals are sent to continuously actuate the braking mechanism.

Numerous types of actuators which are known in the art can be used. In various embodiments, actuators can be mechanical, electrical or hydraulic. In some embodiments, the brake 102 completely prevents the plurality of panels 102 from sliding soon after the first sensor 119 is engaged. Sensors 119 and 121 may emit be of the variety which emit an invisible beam of light but other beams may be used without departing from the spirit of the present invention.

In other embodiments, the braking mechanism activates the tensioning mechanism 118 to provide enough retardation to the rotation of the upper shaft 106 to completely prevent the rotation thereby preventing rotation of sprocket 104 and downward articulation of endless belt 103 of panels 102.

Numerous types of brakes known in the art can be used. In various embodiments, the brake 102 can be a clutch or other type of mechanical brake that applies sufficient force upon the shaft 106 to prevent it's rotation. Thus, rotation of sprocket 104 and articulation of endless loop 103 are prevented.

While the preferred embodiment of the present invention has been described above to include an endless belt 103 of articulating panels 102 and ratcheting handle grip assemblies 109, it is anticipated that the endless belt 103 could be replaced by an endless rope for climbing. In the rope embodiment, handle grip assemblies 109 would not be necessary since the user would simply grip the rope. Similar tensioning and braking mechanisms could be provided to retard or arrest articulation of the endless rope to control the position and movement of a user climbing the rope.

I claim:

1. An exercise device comprising:

a) a frame having two opposing sides each with at least one guiding channel;

b) a plurality of panels hingedly connected together to form an endless loop, each of said plurality of panels including a front face and two ends; wherein one of said two ends of each of said plurality of panels is received in the guiding channel of one of said two opposing sides and the other of said two ends is received in the guiding channel of the other of said two opposing sides such that upon articulation of said endless loop, said plurality of panels slide in said guiding channels;

c) a plurality of lock plates, having upper and lower surfaces, connected to said front faces of said plurality of panels at said lower surfaces;

d) a plurality of retaining plates mated to said upper surfaces of said lock plates;

e) a plurality of hand grip assemblies including upper handle portions and lower rectangular portions; wherein each of said lower rectangular potions include a bottom surface and a pivot lever; and wherein said bottom surface slides on said front faces of said plurality of panels and said pivot lever engages said lock plate at a lock plate tooth;

f) a sprocket having sprocket teeth, said sprocket being mounted to a shaft such that rotation of the sprocket about its central axis transmits the rotation to the shaft and wherein said sprocket teeth engage consecutive panels of said plurality of panels as said endless loop articulates and thus said sprocket and said shaft rotate in response to articulation of said endless loop;

g) an adjustable tensioning mechanism mounted on said frame and configured to apply a retarding force to said shaft to slow rotation of said shaft and said sprocket;

h) a braking mechanism mounted on said frame and configured to apply an arresting force to said shaft to selectively prevent rotation of said shaft and said sprocket;

i) first and second beam reflectors;

j) first and second sensors in communication with said braking mechanism; wherein said sensors further comprise beam emitting mechanisms and beam receiving mechanisms configured to receive beams reflected at said beam reflectors such that when beam receiving mechanisms are prevented from receiving reflected beams, a signal to said braking mechanism to apply said arresting force is not sent to said braking mechanism;

k) a plurality of feet mounted to said frame to allow for mounting of said exercise device to a vertical surface such as a wall.

* * * * *